US007039342B2

(12) United States Patent
Nakane et al.

(10) Patent No.: US 7,039,342 B2
(45) Date of Patent: May 2, 2006

(54) CHARGING DEVICE AND IMAGE FORMING APPARATUS WHERE THE CHARGING DEVICE IS COMPOSED OF A SUFFICIENT AMOUNT OF NICKEL TO SUPPRESS OXIDATION

(75) Inventors: Yoshiki Nakane, Toyokawa (JP); Futoshi Okazaki, Toyokawa (JP); Tomohiro Kawasaki, Toyokawa (JP); Shinji Ogawa, Toyokawa (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 1 day.

(21) Appl. No.: 10/808,367

(22) Filed: Mar. 25, 2004

(65) Prior Publication Data

US 2005/0047829 A1 Mar. 3, 2005

(30) Foreign Application Priority Data

Aug. 29, 2003 (JP) ..... 2003-305757
Feb. 18, 2004 (JP) ..... 2004-040890

(51) Int. Cl.
*G03G 15/02* (2006.01)

(52) U.S. Cl. ..... 399/170; 399/171; 399/172

(58) Field of Classification Search ..... 399/170, 399/171, 172
See application file for complete search history.

(56) References Cited

U.S. PATENT DOCUMENTS

| | | | | | |
|---|---|---|---|---|---|
| 3,932,877 | A | * | 1/1976 | Ohnishi | 347/140 |
| 4,585,320 | A | * | 4/1986 | Altavela et al. | 250/325 |
| 4,585,323 | A | * | 4/1986 | Ewing et al. | 250/325 |
| 4,792,680 | A | * | 12/1988 | Lang et al. | 250/325 |
| 4,920,266 | A | * | 4/1990 | Reale | 250/324 |
| 5,257,073 | A | * | 10/1993 | Gross et al. | 399/171 |
| 5,466,938 | A | * | 11/1995 | Nakayama et al. | 250/326 |
| 5,666,604 | A | * | 9/1997 | Nakagami et al. | 399/171 |
| 6,208,499 | B1 | | 3/2001 | Yonekawa et al. | |

FOREIGN PATENT DOCUMENTS

| | | |
|---|---|---|
| JP | 7-28299 | 1/1995 |
| JP | 11-40316 | 2/1999 |

* cited by examiner

*Primary Examiner*—Quana Grainger
(74) *Attorney, Agent, or Firm*—Morrison & Foerster LLP

(57) ABSTRACT

A charging device has a discharging electrode, a stabilizer plate having a rectangular section and accommodating the discharging electrode, and a grid arranged in a opening of the stabilizer plate, and at least one member of the discharging electrode, the stabilizer plate and the grid is made of an electrically conductive material containing 30% or more of nickel by weight or is plated with nickel or platinum at a rate from 30% to 80% by weight with respect to whole weight of the plated member. An image forming apparatus employs the charging device.

16 Claims, 6 Drawing Sheets

CHARGING DEVICE AND IMAGE FORMING APPARATUS WHERE THE CHARGING DEVICE IS COMPOSED OF A SUFFICIENT AMOUNT OF NICKEL TO SUPPRESS OXIDATION

CROSS-REFERENCE TO RELATED APPLICATION

This application is based on Japanese patent application No.2003-305757 filed in Japan on Aug. 29, 2003, and Japanese patent application No.2004-40890 filed in Japan on Feb. 18, 2004, the entire contents of which are hereby incorporated by reference.

BACKGROUND OF THE INVENTION

1. Field of the Invention

The invention relates to a charging device for use in an image forming apparatus as well as the image forming apparatus.

2. Description of Related Art

Charging devices are employed, e.g., in electrophotographic image forming apparatuses and particularly in various kinds of recording devices such as electrophotographic copying machines, facsimile machines and printers, and electrophotographic display devices.

For example, in an electrophotographic recording device, a charging device charges a surface of an image carrying member to bear a uniform potential, and image exposure corresponding to an image to be formed is effected on a region thus charged. Thereby, an electrostatic latent image is formed, and then is developed with toner to form a toner image, which is then transferred onto a recording medium such as transfer paper, and is fixed thereto by heat and pressure.

Further, a charging device may be used as a transfer charger for transferring the toner image onto the recording medium, and may also be used as a separation charger for separating the recording medium from the image carrying member after the transfer of the toner image.

Corona discharging devices are often used as charging devices in the image forming apparatuses. Typically, the corona discharging device includes a discharging electrode, which extends along a charge target member, i.e., a member to be charged, a so-called "stabilizer plate" or a so-called "shield casing" accommodating the discharging electrode, and a grid arranged in an opening formed in the stabilizer plate and is opposed to the charge target member.

A high voltage is applied to the discharging electrode, and a grid voltage is applied to the grid. The grid controls an amount of electric charges applied to the charge target member.

The discharging electrode may be formed of, e.g., a discharging wire or an electrode having a saw-toothed discharging end, as is known.

The discharging electrode, stabilizer plate and grid of the corona discharging device may be made of stainless steel having high corrosion resistance for minimizing oxidation of these parts because the corona discharging device generates ozone.

According to the discharging device disclosed in Japanese Laid-Open Patent Publication No. H7-28299 (28299/1995), the discharging electrode is formed of a saw-toothed discharging electrode, which generates a smaller amount of ozone than the wire electrode, and at least the discharging end portion (saw-toothed portion) is formed of an electrically conductive material containing 8%–15% of nickel and 16%–20% of chromium, or furthermore 2%–3% of molybdenum, or is coated with a material (e.g., dielectric material such as ceramics) having an high electric resistance.

Also, Japanese Laid-Open Patent Publication No. H11-40316 (40316/1999) has disclosed a grid body, which is formed of a perforated plate of stainless steel, and is coated with gold.

However, components of a charging device in an image forming apparatus are oxidized after it is used many times even if the components are made of stainless steel. When at least one of the discharging electrode, stabilizer plate and grid is oxidized to a certain extent, the discharging device, which is configured, e.g., to charge uniformly a surface of an image carrying member, cannot charge various portions of the surface of the image carrying member to bear a uniform potential, which may cause image noises (irregularities in density of a halftone image, striped image noises or the like) and/or adhesion of carrier onto the image carrying member (if two-component developer containing the carrier and tone is used).

According to the structure disclosed in Japanese Laid-Open Patent Publication No. H7-28299, the saw-toothed discharging electrode is employed, and at least the discharging end portion (saw-toothed portion) thereof is formed of an electrically conductive material containing 8%–15% of nickel and 16%–20% of chromium, or furthermore 2%–3% of molybdenum, or is coated with a material (e.g., dielectric material such as ceramics) having an high electric resistance. However, this structure cannot sufficiently suppress the oxidation, and oxidation will considerably occur to cause image noises when used for a long term.

According to the structure disclosed in Japanese Laid-Open Patent Publication No. H11-40316, the charging device member is coated with gold. This structure is excessively expensive.

SUMMARY OF THE INVENTION

Accordingly, an object of the invention is to provide a charging device for use in an image forming apparatus, including a discharging electrode supplied with a high voltage, a stabilizer plate having an opening on a side opposed to a charge target member, and a grid arranged in the opening of the stabilizer plate and supplied with a grid voltage, and particularly to provide the charging device, which can exhibit intended charging performance even after long-term use, as compared with conventional structures, in which all components are made of stainless steel, or a discharging electrode is made of a conductive material containing small amounts of nickel and chromium, or is merely coated with a high-resistance material, and can be less expensive than the structure, in which a charging device component is coated with gold.

Another object of the invention is to provide an image forming apparatus, which can form good images while suppressing image noises for a longer term, as compared with an image forming apparatus having a charging device, in which all components are made of stainless steel, or a discharging electrode is made of a conductive material containing small amounts of nickel and chromium, or is merely coated with a high-resistance material.

The invention provides a charging device (first charging device) for use in an image forming apparatus, including a discharging electrode to be supplied with a high voltage, a stabilizer plate having an opening on a side to be opposed to a charge target member (a member to be charged) and accommodating the discharging electrode, and a grid arranged in the opening of the stabilizer plate and to be supplied with a grid voltage, wherein at least one of the discharging electrode, the stabilizer plate and the grid is made of an electrically conductive material containing 30% or more of nickel by weight.

Also, the invention provides an image forming apparatus (first image forming apparatus) including an image carrying member, a discharging device for charging the image carrying member, an exposing device exposing a charged surface of the image carrying member to form an electrostatic latent image, and a developing device developing the electrostatic latent image with developer, wherein the charging device includes a discharging electrode extending over a length corresponding to a size of the image carrying member and to be supplied with a high voltage, a stabilizer plate having an opening on a side opposed to the image carrying member and accommodating the discharging electrode, and a grid arranged in the opening of the stabilizer plate and to be supplied with a grid voltage, and at least one of the discharging electrode, the stabilizer plate and the grid is made of an electrically conductive material containing 30% or more of nickel by weight.

Further, the invention provides a charging device (second charging device) for use in an image forming apparatus, including a discharging electrode to be supplied with a high voltage, a stabilizer plate having an opening on a side to be opposed to a charge target member and accommodating the discharging electrode, and a grid arranged in the opening of the stabilizer plate and to be supplied with a grid voltage, wherein at least one member of the discharging electrode, the stabilizer plate and the grid is plated with nickel or platinum at a rate from 30% to 80% by weight with respect to whole weight of the plated member.

Further, the invention provides an image forming apparatus (second image forming apparatus) including an image carrying member, a discharging device for charging the image carrying member, an exposing device exposing a charged surface of the image carrying member to form an electrostatic latent image, and a developing device developing the electrostatic latent image with developer, wherein the charging device includes a discharging electrode extending over a length corresponding to a size of the image carrying member and to be supplied with a high voltage, a stabilizer plate having an opening on a side opposed to the image carrying member and accommodating the discharging electrode, and a grid arranged in the opening of the stabilizer plate and to be supplied with a grid voltage, and at least one member of the discharging electrode, the stabilizer plate and the grid is plated with nickel or platinum at a rate from 30% to 80% by weight with respect to whole weight of the plated member.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
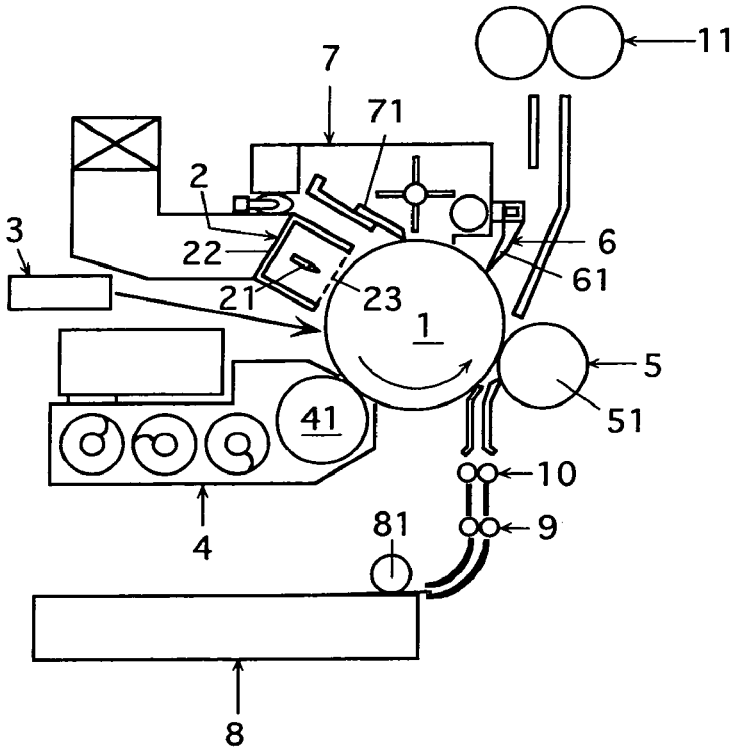
FIG. 1 shows a schematic structure of an image forming apparatus according to a first embodiment of the invention.

A charging device of a first embodiment of the invention basically has the following structure.

The charging device includes a discharging electrode to be supplied with a high voltage, a stabilizer plate (shield casing) having an opening on a side to be opposed to a charge target member (a member to be charged) and accommodating the discharging electrode, and a grid arranged in the opening of the stabilizer plate and to be supplied with a grid voltage.

At least one of the discharging electrode, the stabilizer plate and the grid is made of an electrically conductive material containing 30% or more of nickel by weight.

The conductive material containing 30% or more of nickel (Ni) by weight may be a Ni—Fe alloy or a Ni—Cr—Fe alloy having a nickel content of 30 wt % (30% by weight) or more. In any case, it is preferable that the conductive material has a nickel content of 40 wt % (40% by weight) or more. The nickel content of the conductive material may be 100 wt %, in other words, the conductive material may be nickel.

For using the foregoing conductive material in the charging device, a Young's modulus of the conductive material is preferably equal to 110 KN/mm$^2$ or more, and more preferably is in a range from 110 KN/mm$^2$ to 240 KN/mm$^2$. The discharging electrode, stabilizer plate and/or grid of the charging device made of the conductive materials having the above Young's modulus can have a sufficient rigidity. The Young's modulus can be measured according to JIS Z2280.

The Young's modulus of the conductive materials containing nickel changes in accordance with the nickel content.

According to an example of measurement already made, the Young's modulus of Ni—Fe alloy changes in accordance with the Ni-content as follows.

| Nickel Content (%) | Young's modulus (KN/mm$^2$) |
|---|---|
| 36 | 140 |
| 42 | 147 |
| 46 | 158 |
| 50 | 162 |
| 79 | 200 |
| 100 | 210 |

The Ni—Fe alloy may be YEF42, YEF50, YEF52, YEF36, YEF-BX and YEF-C, which are manufactured by Hitachi Metals Ltd. and have Ni-contents of 42, 50, 52, 36, 46 and 79 wt %, respectively.

The Ni—Cr—Fe alloy may be YEF42-6, which has a Ni-content of 42 wt % and is manufactured by Hitachi Metals Ltd.

A charging device of another embodiment of the invention basically has the following structure.

The charging device includes a discharging electrode to be supplied with a high voltage, a stabilizer plate having an opening on a side to be opposed to a charge target member and accommodating the discharging electrode, and a grid arranged in the opening of the stabilizer plate and to be supplied with a grid voltage.

At least one member of the discharging electrode, the stabilizer plate and the grid is plated with nickel or platinum at a rate from 30% to 80% by weight with respect to whole weight of the plated member.

In either of image forming apparatuses employing the charging devices of the foregoing embodiments, respectively, the same voltage may be applied to the stabilizer plate and the grid.

When the same voltage is applied to keep the same potential in the grid and the stabilizer plate, a large amount of current flows to the grid so that the grid is oxidized remarkably, and a surface potential of the charge target member will rise rapidly in accordance with use of the charging device. In the structure configured to keep the same potential in the grid and the stabilizer plate, therefore, it is preferable that at least the grid is made of a conductive material having a nickel content of 30% or more by weight, or that the grid is plated with nickel or platinum at a rate from 30 wt % to 80 wt % with respect to whole weight of the plated grid.

Either of the charging devices of the foregoing embodiments can be employed in the image forming apparatus.

The image forming apparatus requires a charging device, and typically may be an electrophotographic image forming apparatus. For example, the image forming apparatus includes an image carrying member, a charging device for charging the image carrying member, an exposing device for exposing a charged surface of the image carrying member to form an electrostatic latent image, and a developing device for developing the electrostatic latent image with developer.

From a viewpoint of print color, purpose and others, the electrophotographic image forming apparatus may be a recording device such as monochrome, mono-color or full-color copying machine, a facsimile machine or a printer, or a display device.

The above image forming apparatus can employ either of the charging devices of the foregoing first and second embodiments as the device for charging the image carrying member.

According to the charging device of the first embodiment, at least one of the discharging electrode, stabilizer plate and grid is made of the conductive material containing a large amount of nickel, which is a material having a high corrosion resistance, at a content of 30 wt % or more. Even after long-term use, therefore, oxidation of member(s) made of the conductive material having the nickel content of 30 wt % or more can be suppressed, and thus the whole charging device can exhibit an intended charging performance for a long term.

The image forming apparatus provided with the charging device of the first embodiment can form good images with less image noises for a long term.

According to the charging device of the second embodiment, at least one of three members, i.e., the discharging electrode, stabilizer plate and grid is plated with the nickel or platinum, which is a material having a high resistance to oxidation, and the plating is effected at a high rate from 30% to 80% by weight with respect to whole weight of the plated member. Even after long-term use, therefore, oxidation of the plated member(s) can be suppressed, and thus the whole charging device can exhibit an intended charging performance for a long term.

The image forming apparatus provided with the charging device of the second embodiment can form good images with less image noises for a long term.

Both the charging devices of the foregoing embodiments can exhibit an intended charging performance for long-term use, as compared with conventional structures, in which all components are made of stainless steel, or a discharging electrode is made of a conductive material containing a small amount of nickel or chromium, or is coated with a high-resistance material. Further, both the charging devices of the foregoing embodiments can be more inexpensive than a structure having a charging device member coated with gold.

The image forming apparatuses employing the above charging devices of the embodiments can form good images with less image noises for a longer time, as compared with conventional image forming apparatuses employing charging devices, in which all components are made of stainless steel, or a discharging electrode is made of a conductive material containing a small amount of nickel or chromium, or is coated with a high-resistance material.

Examples of the charging devices and the image forming apparatuses according to the embodiments will now be described.

FIG. 1 shows an example of an image forming apparatus.

The image forming apparatus shown in FIG. 1 basically has an image carrying member 1 as well as a charging device 2, an image exposing device 3, a developing device 4, a transfer device 5, a separating device 6 and a cleaning device 7, which are successively arranged around the image carrying member 1.

In this example, the image forming apparatus is a printer, the image carrying member 1 is a photosensitive drum, and the charging device 2 is a corona discharging device according to the embodiment of the invention. The image exposing device 3 is a laser exposing device, the developing device 4 is a one-component developing device performing reversal development, and the transfer device 5 includes a transfer roller 51. The separating device 6 is of a type having separator member 61 to be in contact with the image carrying member 1, and the cleaning device 7 is of a blade type having a blade 71 to be in contact with the image carrying member 1.

The photosensitive drum 1 and other rotating members are driven to rotate by a drive unit (not shown). The drum 1 rotates counterclockwise in FIG. 1. The charging device 2 will be described later in greater detail. The image exposing device 3 effects laser exposure on the surface of the photosensitive drum 1 in accordance with an image to be formed. The developing device 4 includes a developing roller 41 and others, and a power source (not shown) applies a developing bias to the developing roller 41 for image formation. The transfer roller 51 is supplied with a transfer voltage from a power source (not shown) for transferring the toner image.

A cassette 8 accommodating sheets S of transfer paper is arranged under the photosensitive drum 1. A sheet feed roller 81 pulls out the sheets S from the cassette 8 one by one for supplying them. A guide roller pair 9 and a timing roller pair 10 are arranged between the cassette 8 and a transfer region including the transfer roller 51, and a fixing device 11 and a sheet discharge tray (not shown) are arranged above the transfer region.

According to this printer, the charging device 2 charges the surface of the photosensitive drum 1 to have a uniform potential, and the exposing device 3 effects the image exposure on the charged region of the surface of the drum 1 to form the electrostatic latent image. The developing device 4 develops the electrostatic latent image to form a toner image. Along with the above operation, the transfer sheet S is fed from the cassette 8, and is sent to the transfer region by the timing roller pair 10 in synchronization with the toner image on the photosensitive drum 1. In the transfer region, the transfer roller 51 transfers the toner image onto the sheet S, and subsequently, the separator member 61 separate the sheet S from the photosensitive drum 1. The sheet S is then guided to the fixing device 11, which fixed the toner image by heat and pressure, and thereafter is discharged onto the sheet discharge tray. The cleaner 7 removes untransformed toner remaining the photosensitive drum 1.

Figure 2:
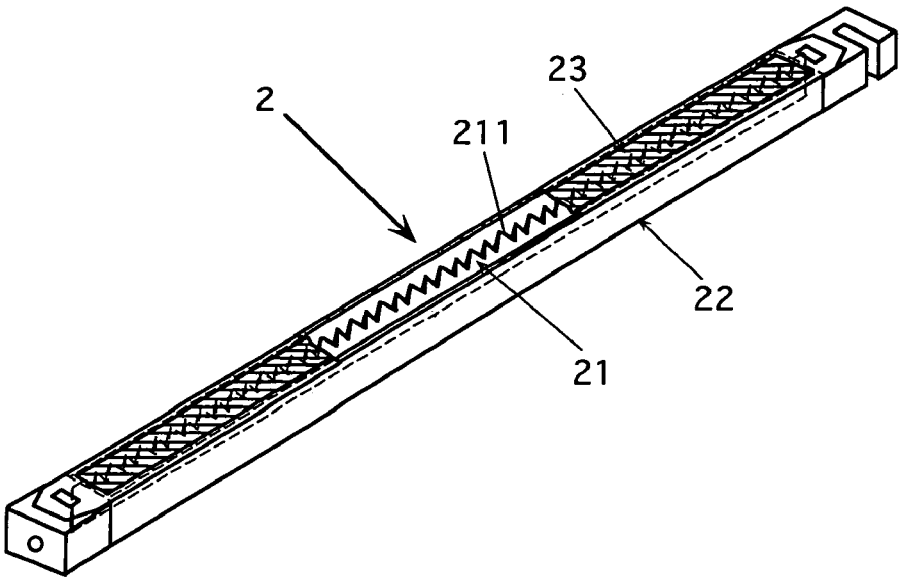
FIG. 2 is a perspective view showing a charging device of the image forming apparatus shown in FIG. 1 with a certain portion of a grid cut away.

The charging device 2 will now be described with reference to FIGS. 1 and 2 and others. FIG. 2 is a perspective view of the charging device 2 with a certain part of the grid cut away.

The charging device 2 has a discharging electrode 21, which extends along a rotation axis of the photosensitive drum 1 over a width of the drum 1, and the discharging electrode 21 has a saw-toothed discharge end portion 211 for corona discharging.

The charging device 2 has a stabilizer plate (shield casing) 22 having a rectangular section, and the discharging electrode 21 is arranged in the stabilizer plate 22. The stabilizer plate 22 has an opening at a portion opposed to the photosensitive drum 1, and a grid 23 is arranged along the opening. The saw-toothed discharge end portion 211 of the discharging electrode 21 is opposed to the surface of the photosensitive drum 1 with the grid 23 therebetween.

For image formation, a power source (not shown) supplies a high voltage to the discharging electrode 21 for charging the surface of the photosensitive drum 1. A power source (not shown) supplies a grid voltage to the grid 23 so that an amount of charges to be applied to the surface of the photosensitive drum 1 is controlled.

In the charging device 2, at least one of the discharging electrode 21, stabilizer plate 22 and grid 23 is made of a conductive material containing nickel at a content of 30% or more by weight. Thereby, the charging device 2 can exhibit an intended charging performance even after long-term use, and can be more inexpensive than a structure having one or more of such members coated with gold. Since the image forming apparatus shown in FIG. 1 employs the foregoing charging device 2, it can form good images, in which image noises are suppress, for a long term.

Description will now be given on an experiment 1 for evaluating the charging performance of the charging device 2, in which the grid 23 is made of a material having a Ni-content of 30 wt % or more, as well as a comparative experiment 1 for evaluating a charging performance of a charging device, which has the same basic structure as the charging device 2 except for that the respective members are made of conventional material. Both the experiment 1 and the comparative experiment 1 were performed with the photosensitive drum 1, which can be charged negatively, and the charging device operated with the grid voltage of −500 V. The respective portions of the charging devices have the same forms and sizes.

<Experiment 1>

Material of Discharging Electrode 21: stainless steel SUS304

Material of Stabilizer Plate 22: stainless steel SUS430

Material of Grid 23: Ni—Fe alloy YEF42 containing 42 wt % Ni

Figure 3:
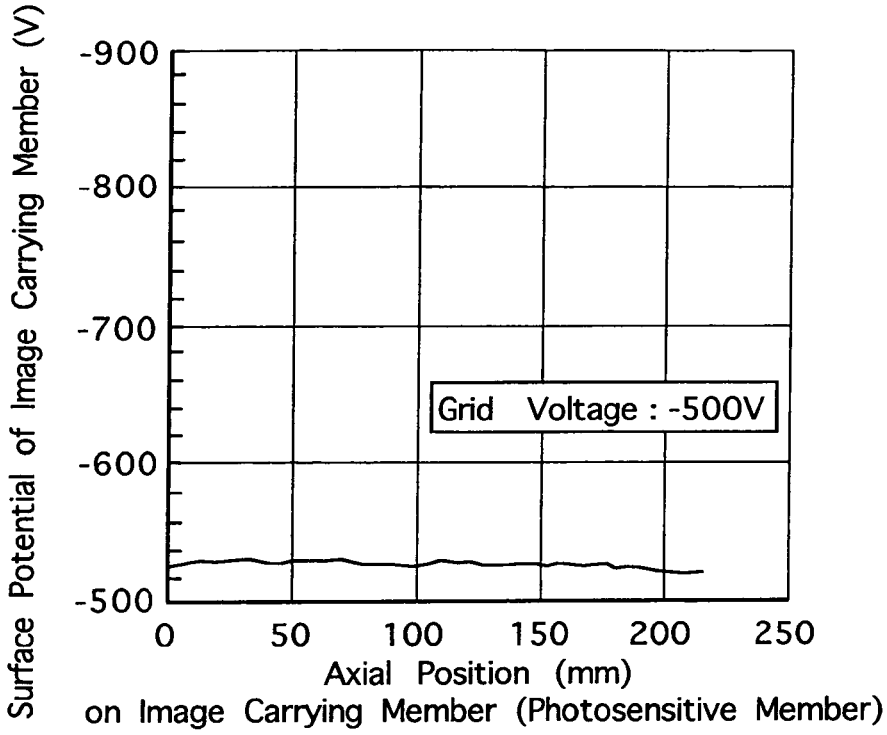
FIG. 3 shows, by way of example, surface potentials at various axial positions of an image carrying member (photosensitive drum in this example) applied by a charging device in an experiment 1 in an initial stage of use.
Figure 4:
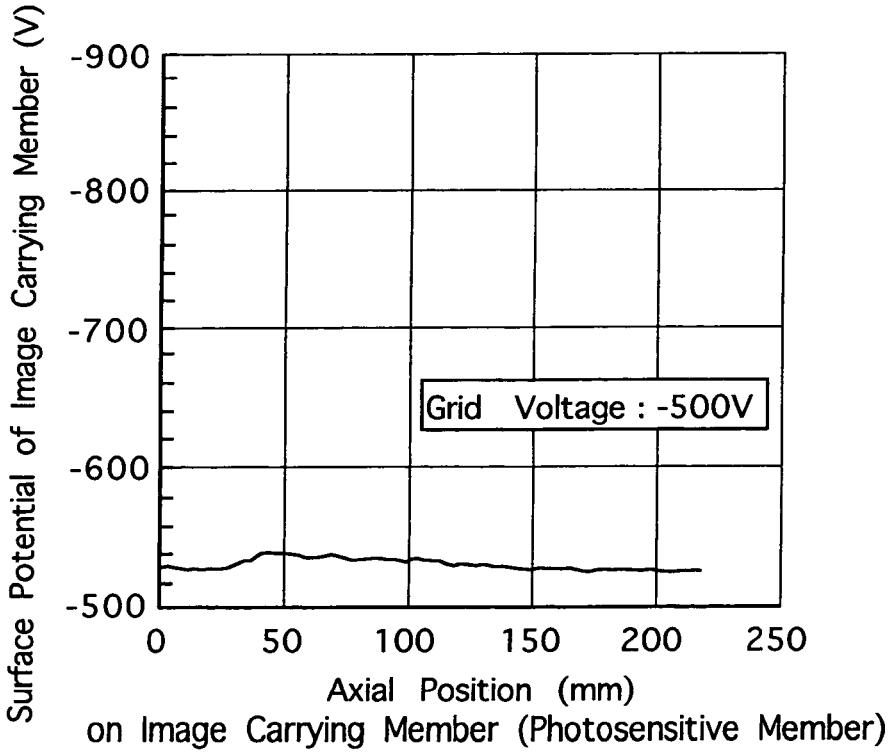
FIG. 4 shows, by way of example, surface potentials at various axial positions of the image carrying member applied by the charging device in the experiment 1 after long-term use.
Figure 5:
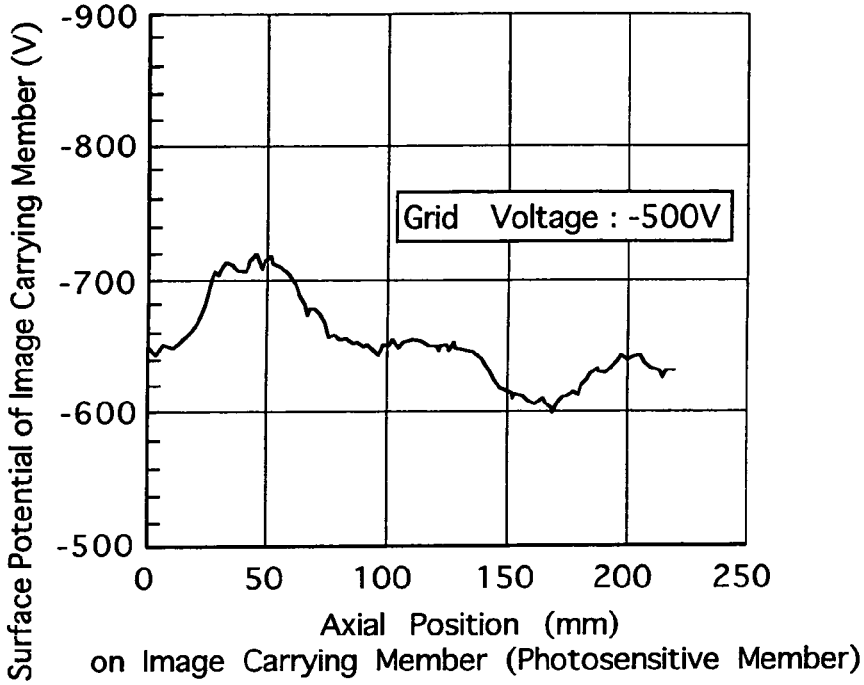
FIG. 5 shows, by way of example, surface potentials at various axial positions of the image carrying member (photosensitive drum in this example) applied by a charging device in a comparative experiment 1 using conventional materials in various members after long-term use.

Evaluation of Charging Performance:

In an initial stage of use of the charging device, as illustrated in FIG. 3, a uniform surface potential of about −530 V was achieved over an entire width in the axial direction of the photosensitive drum 1 opposed to the discharging electrode 21. For 90 hours after the above state, image formation was performed with a chart of a B/W ratio of 5%, and the surface potential of the photosensitive member was measured. According to the result, as shown in FIG. 4, the surface potential of the photosensitive drum was substantially the same as that in the initial state. Image noises causing a problem did not occur. The grid was observed, but adhesion of a foreign material such as oxide, which may cause a problem, was not present.

<Comparative Experiment 1>

All the discharging electrode, stabilizer plate and grid are made of stainless steel SUS304 having a Ni-content of 10 wt %.

Evaluation of Charging Performance:

In the initial stage of use of the charging device, a uniform surface potential of about −530 V was achieved over the entire width in the axial direction of the photosensitive drum 1, similarly to the charging device of the experiment 1. After the image formation was performed similarly to the experiment 1, however, the surface potential of the photosensitive drum negatively rises to −600 V—−700 V, and large variations occur depending on the axial position of the photosensitive drum.

When the above state occurs particularly in an operation of forming halftone images, the image density lowers in the portion having the raised surface potential so that a uniform image density cannot be achieved. If a developing device using a two-component developer including the toner and the carrier is used, the carrier may adhere onto the image carrying member. Observation was performed on the grid and the stabilizer plate of the charging device, which caused rising of the surface potential of the photosensitive member. According to the result, a large amount of foreign materials such as oxide or the like were adhered, and the surface was discolored brown.

A work was also performed to determine a relationship between the Ni-content of the material of the charging device member and the change in surface potential of the photosensitive drum after use in the same manner as the experiment 1.

Figure 6:
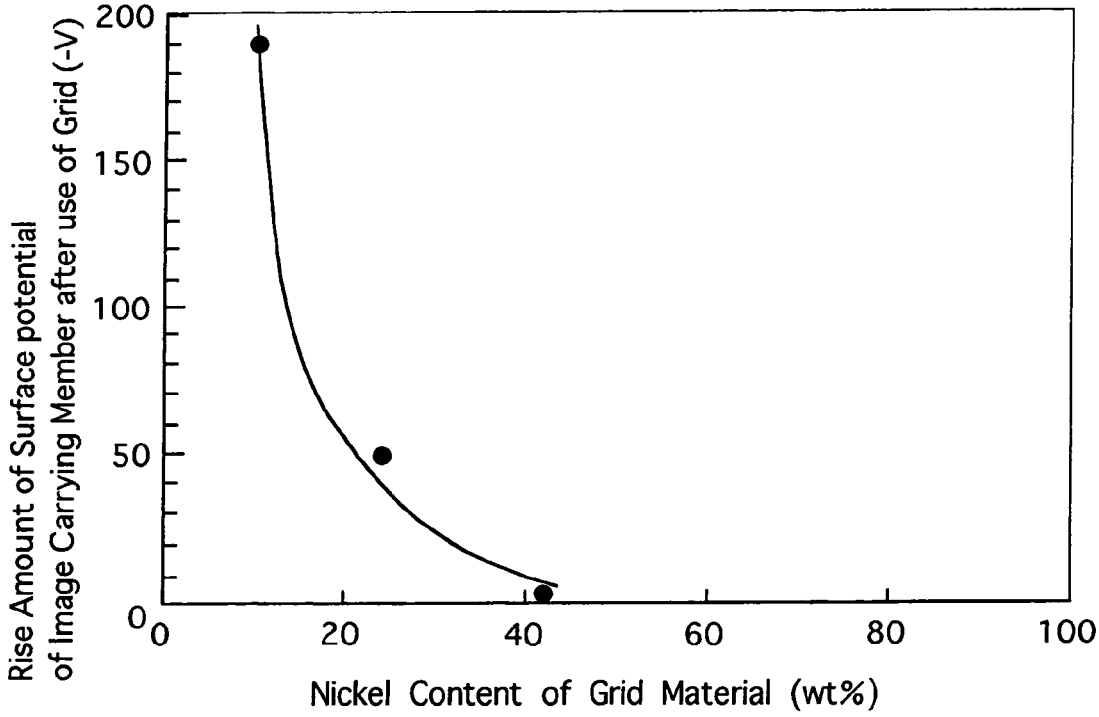
FIG. 6 shows, by way of example, a rise in surface potential of the image carrying member with respect to change in nickel content of the grid of the charging device shown in FIG. 2.

In connection with the charging device of the experiment 1, the work was also performed to determine a relationship between the Ni-content of the grid material and the change, which occurred in surface potential of the photosensitive drum after image formation with a chart of B/W ratio of 5% was performed for 90 houses from the start of use of the charging device. FIG. 6 illustrates the results, and thus a relationship between the Ni-content of the grid material and the rise in surface potential of the photosensitive drum.

Figure 7:
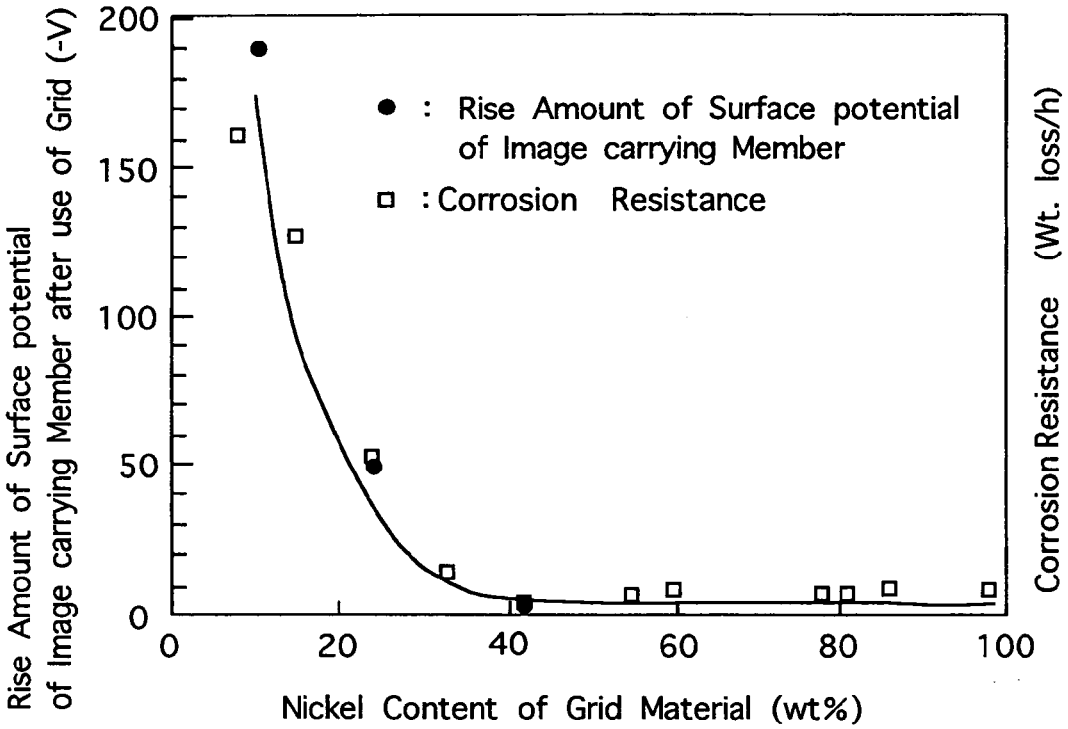
FIG. 7 shows, by way of example, a rise in surface potential of the image carrying member and corrosion resistance of the grid of the charging device shown in FIG. 2 with respect to change in nickel content of the grid.

FIG. 7 illustrates a result of corrosion resistance test conducted on the conductive material as well as the amount or degree of the charging of the photosensitive drum surface with various values of the Ni-content. In other words, FIG. 7 illustrates the relationship between the Ni-content of the grid material and the change in surface potential of the photosensitive drum as well as a relationship between the Ni-content of the grid material and the corrosion resistance of the grid (i.e., loss in weight per hour in this example).

As can be seen from FIGS. 6 and 7, the surface potential of the photosensitive drum negatively rose about 200 V at the most from the initial level at the start of use if the charging device used in the image formation had the grid made of a material similar to SUS304 or the like, which has a Ni-content of about 10 wt % and is generally used as a material of conventional charging device members. If the Ni-content was about 25 wt %, the surface potential of the photosensitive member rose about 50 V, and thus the rise in surface potential of the photosensitive member could be small. If the Ni-content was increased to 42 wt %, the surface potential of the photosensitive member rose about 0 V, and thus the surface potential of the photosensitive member could be maintained similar to that in the initial stage of use of the charging device even after a long-term use. From FIG. 7, it can also be understood that the rising of the surface potential of the photosensitive member corresponds to the corrosion resistance.

From FIGS. 6 and 7, it can be seen that the grid material having the Ni-content of about 30 wt % or more can suppress rising of the surface potential of the photosensitive member. Although FIGS. 6 and 7 relate to the grid material, the stabilizer plate and the discharging electrode, which are made of the material having the Ni-content of about 30 wt % or more, can suppress a difference in surface potential of the photosensitive member between the initial stage of use of the charging device and a later stage.

Figure 8:
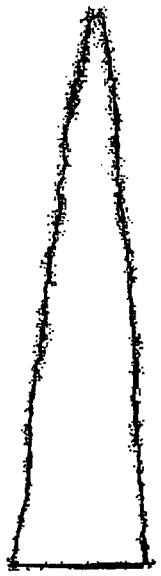
FIG. 8 schematically shows, by way of example, a state of the discharging electrode in an initial stage of use of the charging device.
Figure 9:
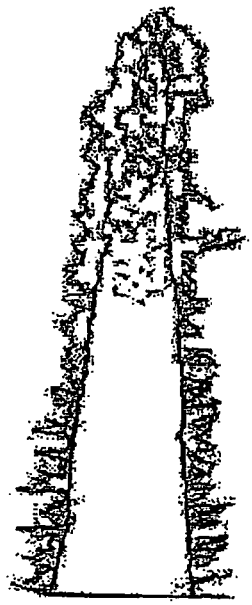
FIG. 9 schematically shows, by way of example, a state of the discharging electrode having a nickel content of 30% or more by weight after long-term use.

For example, the discharging electrode 21 may be made of YEF42 having the Ni-content of 42 wt %. In this case, adhesion of foreign materials such as oxide to the discharging end portion 211 could not be recognized in the initial stage of use of the charging device, as schematically shown in FIG. 8. Also, even after the long-term use, adhesion of only a small amount of foreign material was recognized as schematically shown in FIG. 9.

Figure 10:
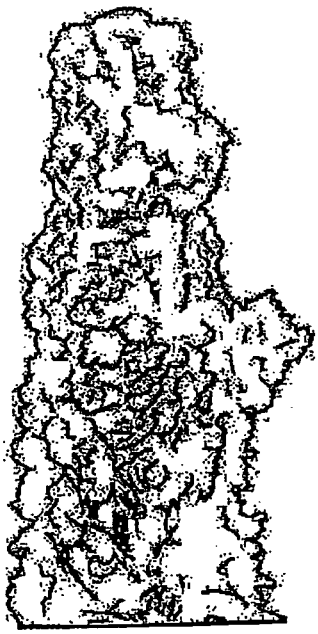
FIG. 10 schematically shows, by way of example, a state of a discharging electrode made of a conventional material after long-term use.

However, if the discharging electrode 21 is made of iron having the Ni-content of about 10 wt %, adhesion of foreign materials such as oxide to the discharging end portion 211 does not occur similarly to the state shown in FIG. 8 when the device is in the initial stage of use of the charging device, but will occur to a larger extent as schematically shown in FIG. 10 after a long-term use of the charging device.

When the charging device including the discharging electrode having a large amount of adhered foreign materials as shown in FIG. 10 is employed, surface potential of a portion of the image carrying member opposed to a portion of the discharging electrode having a large amount of foreign materials is lowered as compared with surface potential of a portion of the image carrying member opposed to a portion of the discharging electrode having no foreign material or having a small amount of foreign materials. Accordingly, a striped image noise occurs in the moving direction of the surface of the image carrying member, when the grid or stabilizer plate made of a material having a small content of nickel is employed.

In the description already given, at least one of the grid, stabilizer plate and discharging electrode is made of a material having the Ni-content of 30 wt % or more. However, at least one member of the grid, stabilizer plate and discharging electrode may be coated with nickel or platinum plating which uses the nickel or platinum at a rate of 30% to 80% by weight with respect to whole weight of the plated member.

If the same potential is kept in the grid and the stabilizer plate, the current flowing to the grid increases, and thus the oxidation of the grid becomes remarkable so that the rise in surface potential of the image carrying member will increase with use of the charging device. Therefore, if the same potential is to be kept in the grid and the stabilizer plate, it is preferable that at least the grid is made of a conductive material having the Ni-content of 30 wt % or more, or the grid is plated with the nickel or platinum at the rate of 30 wt % to 80 wt %.

The plating of the charging device members with the nickel or platinum may be performed by chemical plating, electroplating or the like.

Description will now be given on an experiment 2, in which evaluation was performed on the charging performance of the charging device 2 having the grid 23 coated with nickel as well as a comparative experiment 2, in which evaluation was performed on a charging performance of a charging device having a grid coated with nickel at a different rate. Each of the experiment 2 and the comparative experiment 2 employed the photosensitive drum 1 having a negative charging property, and also employed a grid voltage of −500 V. In each of the charging devices, the respective parts have the same sizes and forms, and the discharging electrode 21 and the stabilizer plate 22 are made of stainless steel SUS304 and stainless steel SUS340, respectively.

<Experiment 2>

Grid 23: A body or base member of stainless steel SUS304 having a Ni-content of 10 wt % was coated with nickel plating at a thickness of 20 μm to provide a nickel content of 57 wt % with respect to the whole weight of the plated grid.

<Comparative Experiment 2>

Grid: A body or base member of stainless steel SUS304 having a Ni-content of 10 wt % was coated with nickel plating at a thickness of 5 μm to provide a nickel content of 28 wt % with respect to the whole weight of the plated grid.

Figure 11:
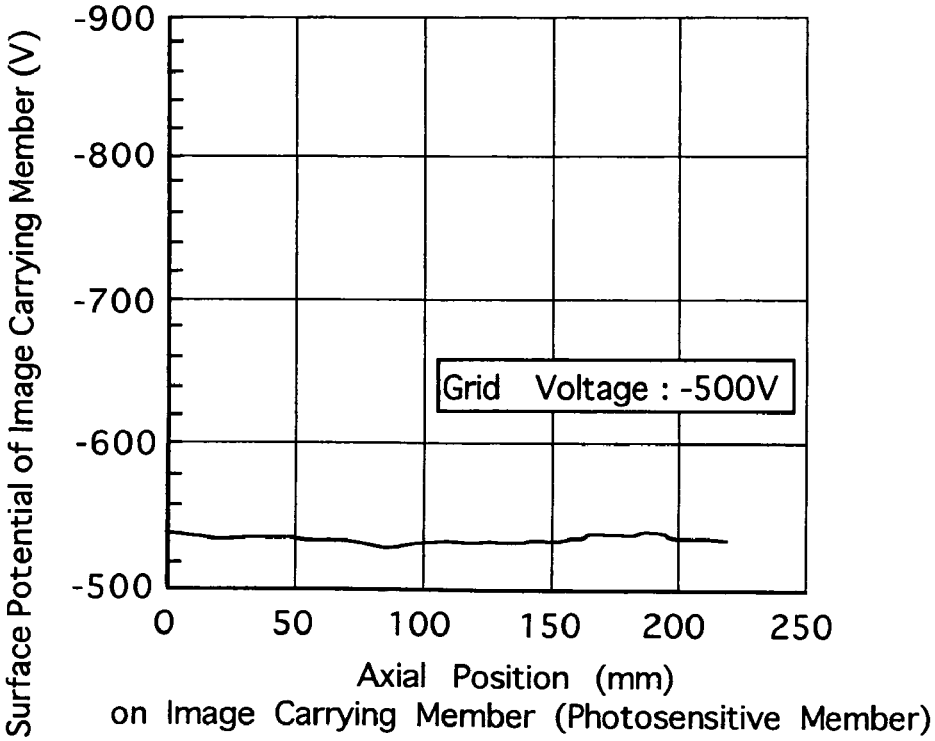
FIG. 11 shows, by way of example, surface potentials at various axial positions of the image carrying member (photosensitive drum in this example) of a charging device in an experiment 2 after long-term use.
Figure 12:
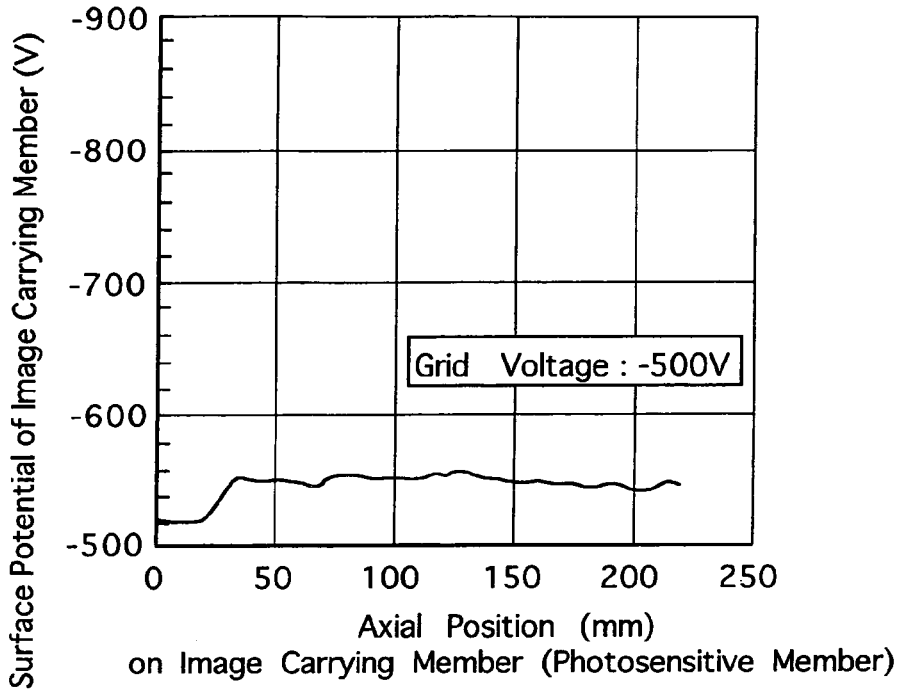
FIG. 12 shows, by way of example, surface potentials at various axial positions of the image carrying member applied by a charging device in a comparative experiment 2 using conventional materials in various members after long-term use.

Evaluation of Charging Property:

In each of the charging devices, the surface potential of the photosensitive member was measured after performing image formation with a chart of a B/W ratio of 5% for 90 hours. According to the results, the charging device in the experiment 2, which employed the grid plated at a large nickel content, provided the surface potential of the photosensitive drum similar to that in the initial stage of use of the device, as illustrated in FIG. 11. Thus, image noises causing a problem did not occur. According to the charging device in the comparative experiment 2, which employed the grid plated at a small nickel content, the surface potential of the photosensitive drum rose from that in the initial stage of use of the device, as illustrated in FIG. 12.

The charging device of the comparative experiment 2 suppressed the rising of the surface potential of the photosensitive member further significantly, as compared with the charging device of the foregoing comparative experiment 1 employing the grid of SUS304 having the Ni-content of 10 wt %, and thus represented the effect of the nickel plating. It is apparent that the nickel plating at a rate of 30 wt % or more with respect to the whole weight of the grid can sufficiently achieve the effect of the nickel plating.

Figure 13:
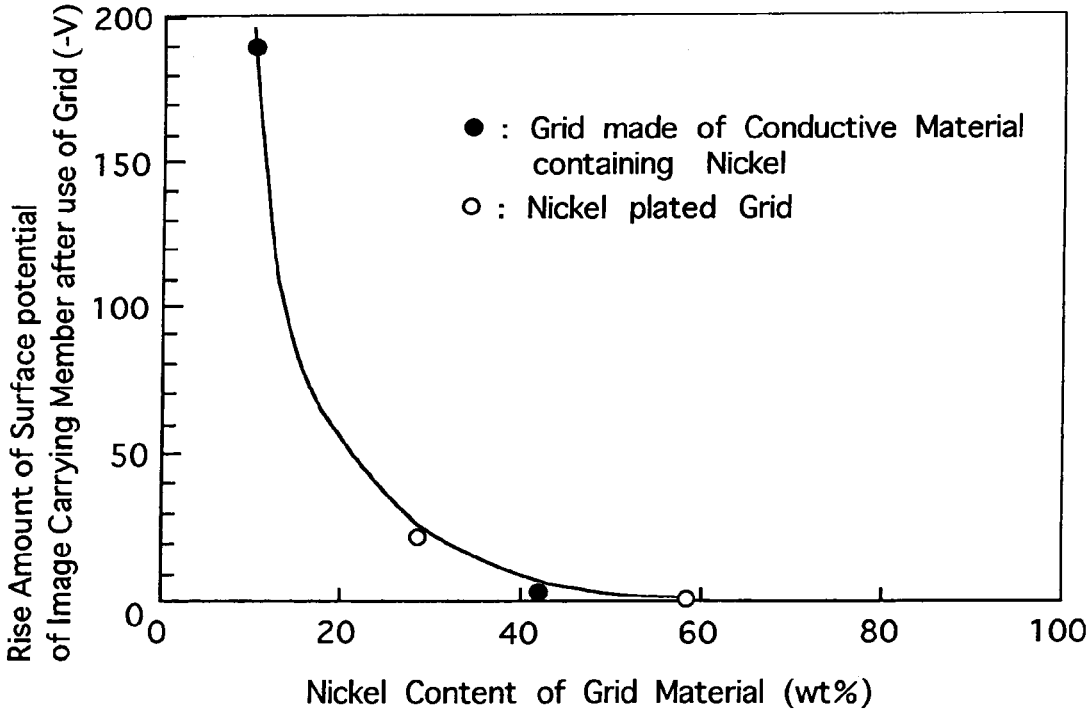
FIG. 13 shows, by way of example, a rise in surface potential of the image carrying member (photosensitive drum in this example) with respect to change in nickel content of a conductive material forming a grid and with respect to change in amount of nickel plating over a grid of a conventional material.

In the charging device of the experiment 1, the Ni-content of the grid material was changed to various values. Also, in the charging device of the experiment 2, the weight rate of the nickel plating with respect to the grid body was changed to various values. Under these conditions, image formation was performed with a chart of B/W rate of 5% for 90 hours, and thereafter the surface potential of the photosensitive drum rose as illustrated in FIG. 13. The following can be seen from FIG. 13. In both the charging devices, the rise in surface potential of the photosensitive drum depends on the nickel content of the whole grid, and both the grid made of a material containing the nickel and the grid plated with the nickel can achieve the similar effects.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A charging device for use in an image forming apparatus, comprising:

a discharging electrode to be supplied with a high voltage;

a stabilizer plate having an opening on a side to be opposed to a charge target member and accommodating said discharging electrode; and a grid arranged in said opening of said stabilizer plate and to be supplied with a grid voltage, wherein at least one of said discharging electrode, said stabilizer plate and said grid is made of an electrically conductive material containing 30% or more of nickel by weight, and said conductive material is an alloy containing nickel and iron.

2. The charging device according to claim 1, wherein said conductive material has a nickel content of 40 wt % or more.

3. The charging device according to claim 1, wherein said conductive material has a Young's modulus of 110 KN/mm2 or more.

4. The charging device according to claim 3, wherein said conductive material has a Young's modulus from 110 $KN/mm^2$ to 240 $KN/mm^2$.

5. A charging device for use in an image forming apparatus, comprising:

a discharging electrode to be supplied with a high voltage;

a stabilizer plate having an opening on a side to be opposed to a charge target member and accommodating said discharging electrode; and a grid arranged in said opening of said stabilizer plate and to be supplied with a grid voltage, wherein at least one of said discharging electrode, said stabilizer plate and said grid is made of an electrically conductive material containing 30% or more of nickel by weight, and said grid and said stabilizer plate are to have same potential, and the grid is made of the conductive material containing 30% or more of nickel by weight.

6. The charging device according to claim 1, wherein said conductive material further includes chromium.

7. A charging device for use in an image forming apparatus, comprising:

a discharging electrode to be supplied with a high voltage;

a stabilizer plate having an opening on a side to be opposed to a charge target member and accommodating said discharging electrode; and a grid arranged in said opening of said stabilizer plate and to be supplied with a grid voltage, wherein at least one member of said discharging electrode, said stabilizer plate and said grid is plated with nickel or platinum at a rate from 30% to 80% by weight with respect to whole weight of the plated member, and a base body of said plated member is made of an alloy containing nickel and iron.

8. A charging device for use in an image forming apparatus, comprising:

a discharging electrode to be supplied with a high voltage;

a stabilizer plate having an opening on a side to be opposed to a charge target member and accommodating said discharging electrode; and a grid arranged in said opening of said stabilizer plate and to be supplied with a grid voltage, wherein at least one member of said discharging electrode, said stabilizer plate and said grid is plated with nickel or platinum at a rate from 30% to 80% by weight with respect to whole weight of the plated member, and said grid and said stabilizer plate are to have same potential, and a base body of the grid is plated with nickel or platinum at a rate from 30% to 80% by weight with respect to whole weight of the plated grid.

9. An image forming apparatus comprising an image carrying member, a discharging device for charging said image carrying member, an exposing device for exposing a charged surface of the image carrying member to form an electrostatic latent image, and a developing device for developing said electrostatic latent image with developer, wherein said charging device includes:

a discharging electrode extending over a length corresponding to a size of the image carrying member and to be supplied with a high voltage, a stabilizer plate having an opening on a side opposed to the image carrying member and accommodating the discharging electrode, and a grid arranged in said opening of said stabilizer plate and to be supplied with a grid voltage, at least one of said discharging electrode, said stabilizer plate and said grid is made of an electrically conductive material containing 30% or more of nickel by weight, and said conductive material is an alloy containing nickel and iron.

10. The image forming apparatus according to claim 1, wherein said conductive material has a nickel content of 40 wt % or more.

11. The image forming apparatus according to claim 1, wherein said conductive material has a Young's modulus of 110 $KN/mm^2$ or more.

12. The image forming apparatus according to claim 1, wherein said conductive material has a Young's modulus from 110 KN/mm2 to 240 KN/mm2.

13. The image forming apparatus according to claim 1, wherein said conductive material further includes chromium.

14. An image forming apparatus comprising an image carrying member, a discharging device for charging said image carrying member, an exposing device for exposing a charged surface of the image carrying member to form an electrostatic latent image, and a developing device for developing said electrostatic latent image with developer, wherein said charging device includes:

a discharging electrode extending over a length corresponding to a size of the image carrying member and to be supplied with a high voltage, a stabilizer plate having an opening on a side opposed to the image carrying member and accommodating the discharging electrode, and a grid arranged in said opening of said stabilizer plate and to be supplied with a grid voltage, at least one of said discharging electrode, said stabilizer plate and said grid is made of an electrically conductive material containing 30% or more of nickel by weight, and said grid and said stabilizer plate are to have same potential, and a base body of the grid is made of a conductive material containing 30% or more of nickel by weight.

15. An image forming apparatus comprising an image carrying member, a discharging device for charging said image carrying member, an exposing device for exposing a charged surface of the image carrying member to form an electrostatic latent image, and a developing device for developing said electrostatic latent image with developer, wherein said charging device includes:

a discharging electrode extending over a length corresponding to a size of the image carrying member and to be supplied with a high voltage, a stabilizer plate having an opening on a side opposed to the image carrying member and accommodating the discharging electrode, and a grid arranged in said opening of said stabilizer plate and to be supplied with a grid voltage, at least one member of said discharging electrode, said stabilizer plate and said grid is plated with nickel or platinum at a rate from 30% to 80% by weight with respect to whole weight of the plated member, and a base body of said plated member is made of an alloy containing nickel and iron.

16. An image forming apparatus comprising an image carrying member, a discharging device for charging said image carrying member, an exposing device for exposing a charged surface of the image carrying member to form an electrostatic latent image, and a developing device for developing said electrostatic latent image with developer, wherein said charging device includes:

a discharging electrode extending over a length corresponding to a size of the image carrying member and to be supplied with a high voltage, a stabilizer plate having an opening on a side opposed to the image carrying member and accommodating the discharging electrode, and a grid arranged in said opening of said stabilizer plate and to be supplied with a grid voltage, at least one member of said discharging electrode, said stabilizer plate and said grid is plated with nickel or platinum at a rate from 30% to 80% by weight with respect to whole weight of the plated member, and said grid and said stabilizer plate are to have same potential, and a base body of the grid is plated with nickel or platinum at a rate from 30% to 80% by weight with respect to whole weight of the plated grid.

* * * * *

UNITED STATES PATENT AND TRADEMARK OFFICE

CERTIFICATE OF CORRECTION

PATENT NO. : 7,039,342 B2 
APPLICATION NO. : 10/808367
DATED : May 2, 2006
INVENTOR(S) : Yoshiki Nakane et al.

It is certified that error appears in the above-identified patent and that said Letters Patent is hereby corrected as shown below:

Col. 11 lines 59-61 should read,
3. The charging device according to claim 1, wherein
said conductive material has a Young's modulus of 110 KN/mm~~2~~ $^{2}$ or more.

Col. 13 lines 1-4 should read,
10. The image forming apparatus according to claim ~~1~~ 9 wherein
said conductive material has a nickel content of 40 wt % or more.

Col. 13 lines 5-8 should read,
11. The image forming apparatus according to claim ~~1~~ 9, wherein
said conductive material has a Young's modulus from 110 KN/mm$^2$ or more.

Col. 13 lines 9-11 should read,
12. The image forming apparatus according to claim ~~1~~ 11, wherein
said conductive material has a Young's modulus from 110
KN/mm2 $^{2}$ to 240 KN/mm2 $^{2}$.

Col. 13 lines 12-14
13. The image forming apparatus according to claim 1 9, wherein
said conductive material further includes chromium.

Signed and Sealed this

Tenth Day of October, 2006

JON W. DUDAS
*Director of the United States Patent and Trademark Office*